US010294941B2

(12) United States Patent
Nishimura et al.

(10) Patent No.: US 10,294,941 B2
(45) Date of Patent: May 21, 2019

(54) SLIDING MEMBER FOR A COMPRESSOR

(71) Applicant: DAIKIN INDUSTRIES, LTD., Osaka-shi, Osaka (JP)

(72) Inventors: Kousuke Nishimura, Sakai (JP); Kazuhiro Furusho, Sakai (JP); Takeyoshi Ohkawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 71 days.

(21) Appl. No.: 15/309,931

(22) PCT Filed: May 12, 2015

(86) PCT No.: PCT/JP2015/063596
§ 371 (c)(1),
(2) Date: Nov. 9, 2016

(87) PCT Pub. No.: WO2015/174400
PCT Pub. Date: Nov. 19, 2015

(65) Prior Publication Data

US 2017/0218954 A1 Aug. 3, 2017

(30) Foreign Application Priority Data

May 12, 2014 (JP) ..... 2014-098447

(51) Int. Cl.
*F01C 21/10* (2006.01)
*F03C 2/00* (2006.01)
(Continued)

(52) U.S. Cl.
CPC ..... *F04C 18/3564* (2013.01); *C22C 21/02* (2013.01); *F04C 18/322* (2013.01);
(Continued)

(58) Field of Classification Search
CPC ..... F04C 23/008; F04C 18/3564; F04C 2230/41; F04C 2230/91; F04C 2230/92;
(Continued)

(56) References Cited

U.S. PATENT DOCUMENTS 3,930,902 A * 1/1976 Hiraoka ..... C22C 33/0257 148/318
5,106,436 A 4/1992 Alabi
(Continued)

FOREIGN PATENT DOCUMENTS

JP 63-307250 A 12/1988
JP 7-293468 A 11/1995
(Continued)

OTHER PUBLICATIONS

European Search Report of corresponding EP Application No. 15 79 2238.6 dated Feb. 8, 2017.
International Search Report of corresponding PCT Application No. PCT/JP2015/063596 dated Aug. 11, 2015.
International Preliminary Report of corresponding PCT Application No. PCT/JP2015/064511 dated Nov. 15, 2016.

*Primary Examiner* — Theresa Trieu
(74) *Attorney, Agent, or Firm* — Global IP Counselors, LLP

(57) ABSTRACT

A compressor includes a cylinder including a cylinder chamber, a piston movably arranged relative to the cylinder in the cylinder chamber, and a sliding member slideable against the cylinder and the piston in the cylinder chamber. The cylinder and the piston are constructed from an Al—Si alloy having a Si content exceeding 12.6 wt %, which is a eutectic point. The sliding member is constructed from steel and has a surface layer including a sliding surface slideable against the cylinder and the piston. The surface layer is treated so as to have greater hardness than hardness of proeutectic Si contained in the Al—Si alloy, and the surface layer has hardness of at least Hv 1000 in the sliding surface.

20 Claims, 9 Drawing Sheets

(51) Int. Cl.

| | |
|---|---|
| ***F03C 4/00*** | (2006.01) |
| ***F04C 15/00*** | (2006.01) |
| ***F04C 18/356*** | (2006.01) |
| ***F04C 23/00*** | (2006.01) |
| ***F04C 18/32*** | (2006.01) |
| ***C22C 21/02*** | (2006.01) |

(52) U.S. Cl.
CPC ..... *F04C 23/008* (2013.01); *F04C 2210/268* (2013.01); *F04C 2230/41* (2013.01); *F04C 2230/91* (2013.01); *F04C 2230/92* (2013.01); *F04C 2240/20* (2013.01); *F04C 2240/30* (2013.01); *F05C 2201/021* (2013.01)

(58) Field of Classification Search
CPC ..... F04C 2240/20; F04C 2240/30; F04C 2240/50; F04C 2240/802; F04C 2210/268; F04C 2210/26; C22C 21/02
USPC ..... 418/11–12, 60, 63–64, 107, 178–179
See application file for complete search history.

(56) References Cited

U.S. PATENT DOCUMENTS

| | | | | | |
|---|---|---|---|---|---|
| 5,548,973 | A | | 8/1996 | Komine et al. | |
| 5,591,023 | A | * | 1/1997 | Nakamura | F04C 2230/22 418/179 |
| 6,139,296 | A | * | 10/2000 | Okajima | F04C 2230/91 418/178 |
| 2008/0050260 | A1 | | 2/2008 | Iwanami et al. | |

FOREIGN PATENT DOCUMENTS

| | | | | | |
|---|---|---|---|---|---|
| JP | 9-176770 | A | | 7/1997 | |
| JP | 11-257225 | A | | 9/1999 | |
| JP | 2004-293558 | A | | 10/2004 | |
| JP | 2007-032360 | A | * | 2/2007 | F04C 2230/91 |
| JP | 2008-88847 | A | | 4/2008 | |
| JP | 2012-149553 | A | | 8/2012 | |
| JP | 2014-5825 | A | | 1/2014 | |

* cited by examiner

SLIDING MEMBER FOR A COMPRESSOR

CROSS-REFERENCE TO RELATED APPLICATIONS

This U.S. National stage application claims priority under 35 U.S.C. § 119(a) to Japanese Patent Application No. 2014-098447, filed in. Japan on May 12, 2014, the entire contents of which are hereby incorporated herein by reference.

TECHNICAL FIELD

The present invention relates to a compressor.

BACKGROUND ART

In the past, there have been used rotary compressors in which a cylinder including a cylinder chamber and a piston accommodated in the cylinder chamber move relative to each other, thereby compressing a refrigerant. In a rotary compressor, the cylinder chamber is sectionalized into two compression chambers, and the refrigerant is compressed by the cyclic increasing and decreasing of the volumes of the compression chambers.

A compressor including a piston having a blade is disclosed as an example of a rotary compressor in Japanese Laid-open Patent Publication No. 2004-29358. The blade, which is formed integrally with the piston, sectionalizes the cylinder chamber into two compression chambers. The blade is sandwiched between a pair of bushings provided in a bushing hole of the cylinder, each bushing having a substantially semicircular cross section. The blade Moves back and forth between the pair of bushings, whereby the bushings oscillate within the bushing hole while sliding against the cylinder and the blade.

In this compressor, because the cylinder and the piston move relative to each other with the bushings therebetween, the portion where the cylinder and bushings slide against each other and the portion where the piston and bushings slide against each other must exhibit exceptional sliding and wear-resistance properties. In the past, iron-based materials have mainly been used as the materials of the cylinders and pistons constituting the sliding portions, but the use of aluminum-based materials has recently been investigated. The cylinder and the piston must be precisely machined in order to make the gap between the bushings as small as possible. With an iron-based material, cutting and a polishing process are needed in order to perform high-precision machining. With an aluminum-based material, cutting alone is sufficient for high-precision machining, and machining costs can be decreased. Furthermore, the weight of the cylinder and the piston can be reduced by changing from an iron-based material to an aluminum-based material.

SUMMARY

Technical Problem

However, when a cylinder and piston made of an aluminum-based material and bushings made of an iron-based material slide against each other, a problem is presented in that slidability and wear resistance are far inferior to when members made of an iron-based material slide against each other. When an Al—Si alloy is used as an aluminum-based material for use as the material of the cylinder and the piston, there is a risk that when an alloy having a low Si content and a eutectic Si composition is used, the cylinder and the piston will experience higher wear, and there is a risk that when an alloy having a high Si consent is used, the amount of wear on the bushings will increase by proeutectic Si in the alloy. When the cylinder, piston, and bushings constituting the sliding portions experience greater wear; there is a risk that the reliability of the compressor will decrease.

An object of the present invention is to provide a compressor that can be reduced in weight and increased in reliability.

Solution to Problem

A compressor according to a first aspect of the present invention comprises a cylinder, a piston, and a sliding member. The cylinder including a cylinder chamber. The piston moves relative to the cylinder in the cylinder chamber. The sliding member slides against the cylinder and the piston in the cylinder chamber. The cylinder and the piston are shaped from an Al—Si alloy having a Si content exceeding 12.6 wt %, which is a eutectic point. The sliding member, which is shaped from steel, has a surface layer including a sliding surface that slides against the cylinder and the piston. The surface layer is reformed so as to have greater hardness than hardness of proeutectic Si contained in the Al—Si alloy. The surface layer also has hardness of at least Hv 1000 in the sliding surface.

In this compressor, the hardness of the surface of the sliding member that slides against the cylinder and the piston is greater than the hardness of the proeutectic Si contained in the Al—Si alloy, which is the material of the cylinder and the piston, and the sliding surface has hardness of at least Hv 1000. Therefore, wear on the sliding member caused by the proeutectic Si is restrained. Because the Si content of the Al—Si alloy is high, wear on the cylinder and the piston is restrained. Moreover, an aluminum-based material such as an Al—Si alloy is lighter in weight than an iron-based material. Consequently, the compressor according to the first aspect of the present invention can be reduced in weight and increased in reliability.

A compressor according to a second aspect of the present invention is the compressor according to the first aspect, wherein the surface layer is reformed by a nitriding process.

A compressor according to a third aspect of the present invention is the compressor according to either the first or second aspect, wherein the reforming is a coating of a DLC thin film. A design indicator (DV), calculated according to the formula: design indicator (DV)=unit maximum load (units: N/mm)/average sliding speed (units: m/s), is less than 67. The unit maximum load is maximum load exerted per unit length of 1 mm on a linear maximum-load part. The linear maximum-load part is a linear portion in the sliding surface where load received from the cylinder or the piston is greatest. The average sliding speed is the average value of the sliding speeds of the linear maximum-load part and either the cylinder or the piston.

A compressor according to a fourth aspect of the present invention is the compressor according to the third aspect, wherein the surface layer has hardness of at least Hv 1200 in the sliding surface.

A compressor according to a fifth aspect of the present invention is the compressor according to any of the first through fourth aspects, wherein the cylinder and the piston are shaped from same material.

In this compressor, the amount of wear on the cylinder and the amount of wear on the piston are of the same degree, and the service life of the cylinder is therefore of the same degree as the service life of the piston. Consequently, it is possible to restrain the decrease in the service life of the compressor according to the fifth aspect of the present invention.

A compressor according to a sixth aspect of the present invention is the compressor according to any of the first through fifth aspects, wherein the piston has a roller and a blade seemed to an outer peripheral surface of the roller. The outer peripheral surface of the roller is formed in a non-circular shape.

A compressor according to a seventh aspect of the present invention is the compressor according to any of the first through sixth aspects, wherein the sliding member is shaped from tool steel.

A compressor according to an eighth aspect of the present invention is the compressor according to any of the first through seventh aspects, wherein R32 is used as a refrigerant.

Advantageous Effects of Invention

The compressor according to the present invention can be reduced in weight and increased in reliability.

DESCRIPTION OF EMBODIMENTS

Figure 1:
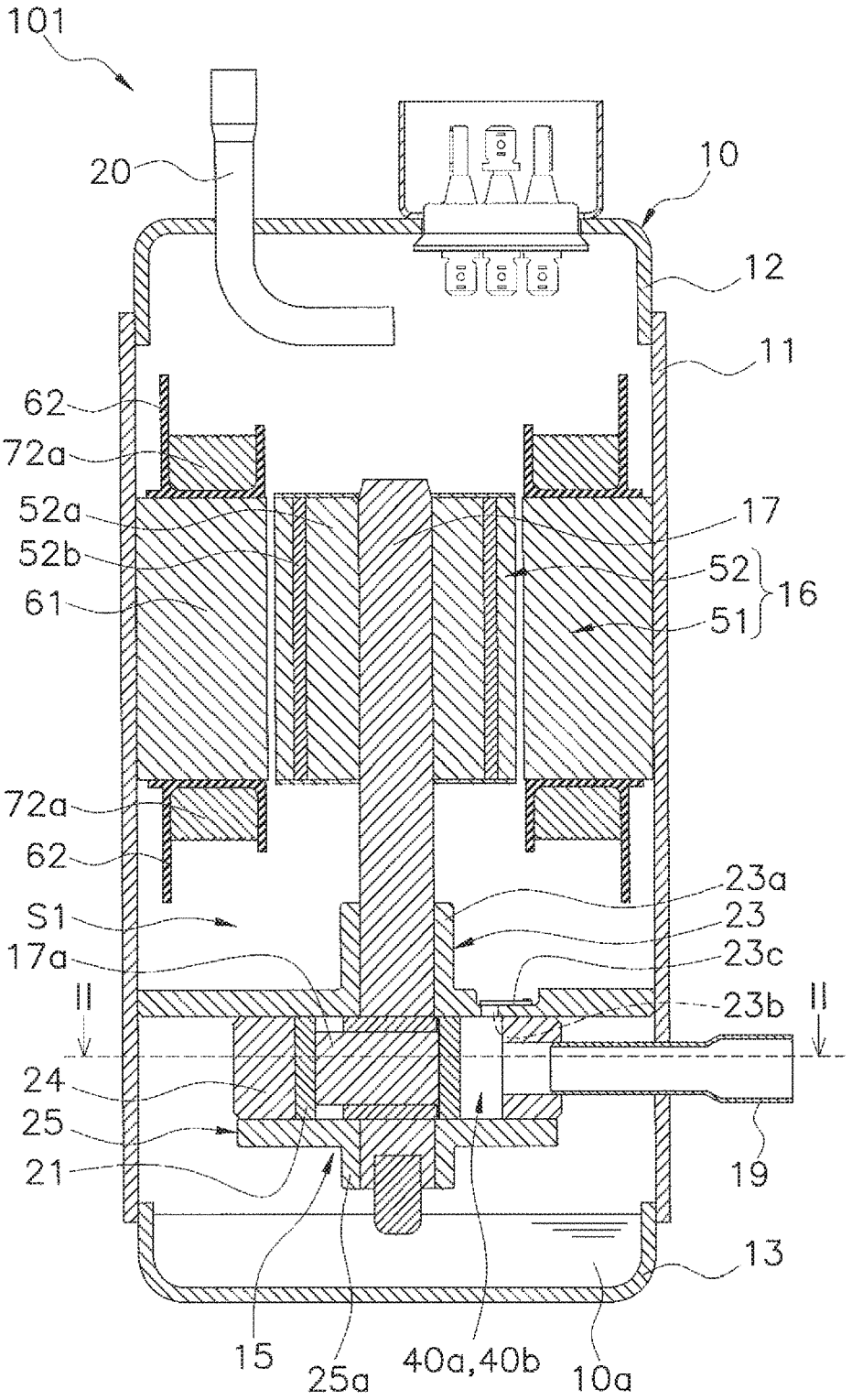
FIG. 1 is a longitudinal cross-sectional view of a rotary compressor according to an embodiment.

A rotary compressor according to an embodiment of the present invention will be described while referring to the drawings. A rotary compressor is one in which a piston is made to rotate eccentrically within a cylinder and the volume of the space inside the cylinder is varied, whereby a refrigerant circulating through a refrigerant circuit of an air-conditioning apparatus, etc., is compressed.

(1) Configuration Of Rotary Compressor

FIG. 1 is a longitudinal cross-sectional view of a rotary compressor 101 according to the present embodiment. The rotary compressor 101 comprises mainly a casing 10, a compression mechanism 15, a drive motor 16, a crankshaft 17, an intake tube 19, and a discharge tube 20. The rotary compressor 101 is a single-cylinder compressor. Examples of the refrigerant that can be used in the rotary compressor 101 include R410A, R22, R32, or carbon dioxide. The constituent elements of the rotary compressor 101 are described next.

(1-1) Casing

The casing 10 has a substantially cylindrical body casing part 11, a bowl-shaped upper wall part 12 hermetically welded to an upper end part of the body casing part 11, and a bowl-shaped bottom wall part 13 hermetically welded to a lower end part of the body casing part 11. The casing 10 is shaped from a rigid member that is not readily deformed or damaged when there are changes in pressure and/or temperature inside and outside the casing 10. The casing 10 is installed so that the axial direction of the substantially cylindrical shape of the body casing part 11 extends along the vertical direction. A bottom part of the casing 10 is provided with an oil storage part 10*a* in which lubricating oil is stored. The lubricating oil is refrigerator oil used in order to lubricate sliding parts inside the rotary compressor 101.

The casing 10 accommodates mainly the compression mechanism 15, the drive motor 16, which is arranged above the compression mechanism 15, and the crankshaft 17, which is arranged so as to extend in the vertical direction. The compression mechanism 15 is linked with the drive motor 16 by the crankshaft 17. The intake tube 19 and the discharge tube 20 are hermetically welded to wall parts of the casing 10.

(1-2) Compression Mechanism

Figure 2:
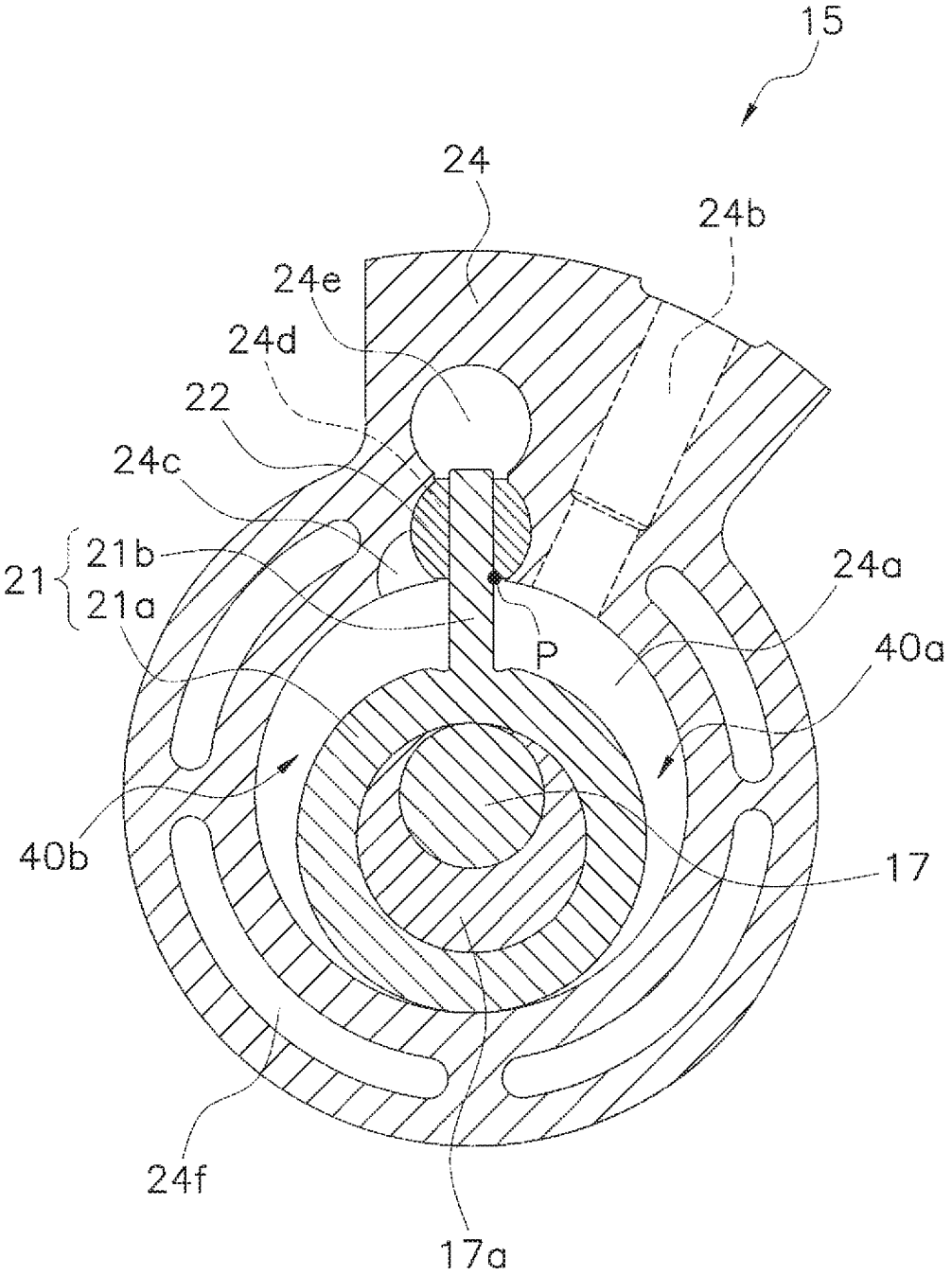
FIG. 2 is a cross-sectional view of a compression mechanism along line II-II of FIG. 1.

FIG. 2 is a cross-sectional view of the compression mechanism 15 along line II-II in FIG. 1. The compression mechanism 15 is configured mainly from a front head 23, a cylinder 24, a rear head 25, a piston 21, and bushings 22. The front head 23, the cylinder 24, and the rear head 25 are fastened integrally by bolts. The space above the compression mechanism 15 is a high-pressure space S1 into which refrigerant compressed by the compression mechanism 15 is discharged.

The compression mechanism 15 is immersed in the lubricating oil, which is stored in the oil storage part 10*a*. The lubricating oil in the oil storage part 10*a* is supplied to the sliding parts of the compression mechanism 15 by differential pressure, etc. The constituent elements of the compression mechanism 15 are described next.

(1-2-1) Cylinder

The cylinder 24 includes mainly a cylinder hole 24*a*, an intake hole 24*b*, a discharge channel 24*c*, a bushing accommodation hole 24*d*, a blade accommodation hole 24*e*, and heat insulation holes 24*f*. The cylinder 24 is linked with the front head 23 and the rear head 25. An end surface on an upper side of the cylinder 24 is in contact with a lower surface of the front head 23. An end surface on a lower side of the cylinder 24 is in contact with an upper surface of the rear head 25. The cylinder 24 is shaped from an Al—Si alloy. The Al—Si alloy, which is the material of the cylinder 24, has a Si content exceeding 12.6 wt %, which is a eutectic point.

The cylinder hole 24*a* is a hole that assumes the form of a column, and passes vertically through the cylinder 24 from the end surface on the upper side of the cylinder 24 toward the end surface on the lower side. The cylinder hole 24*a* is a space enclosed by an inner peripheral surface of the cylinder 24. The intake hole 24*b* is a hole that passes through along a radial direction of the cylinder 24, from an outer peripheral surface of the cylinder 24 toward the inner peripheral surface of the cylinder 24. The discharge channel 24*c* is a space formed without passing vertically through the cylinder 24, due to part of the inner peripheral surface of the cylinder 24 being cut away. The bushing accommodation hole 24*d* is a hole that passes vertically through the cylinder 24, and that is arranged between the intake hole 24*b* and the discharge channel 24*c* as viewed along the vertical direction. The blade accommodation hole 24*e* is a hole that passes vertically through the cylinder 24 and communicates with the bushing accommodation hole 24*d*. The heat insulation hole 24*f* is a hole that passes vertically through the cylinder 24 between the outer peripheral surface of the cylinder 24 and the inner peripheral surface of the cylinder 24. The cylinder 24 has a plurality of heat insulation holes 24*f*.

The cylinder hole 24*a* accommodates an eccentric shaft part 17*a* of the crankshaft 17 and a roller 21*a* of the piston 21. The bushing accommodation hole 24*d* accommodates a blade 21*b* of the piston 21 and the bushings 22. With the blade 21*b* of the piston 21 accommodated in the blade accommodation hole 24*e*, the discharge channel 24*c* is formed in the side near the front head 23.

(1-2-2) Piston

The piston 21 is inserted into the cylinder hole 24*a* of the cylinder 24. The piston 21 has the substantially cylindrical roller 21*a* and the blade 21*b*, which protrudes outward in the radial direction of the roller 21*a*. The piston 21 is a member in which the roller 21a and the blade 21*b* are integrated. An end surface on an upper side of the piston 21 is in contact with the lower surface of the front head 23. An end surface on a lower side of the piston 21 is in contact with the upper surface of the rear head 25. The piston 21 is shaped from an Al—Si alloy. The Al—Si alloy, which is the material of the piston 21, has a Si content exceeding 12.6wt %, which is a eutectic point. The material of the piston 21 is the same as the material of the cylinder 24. In other words, the cylinder and the piston are constructed from a common material.

The roller 21*a* is inserted into the cylinder hole 24*a* of the cylinder 24 while being fitted into the eccentric shaft part 17*a* of the crankshaft 17. The axial rotation of the crankshaft 17 causes the roller 21*a* to perform an orbiting motion about the rotational axis of the crankshaft 17. When the compression mechanism 15 is viewed from above, the roller 21*a* orbits clockwise.

The blade 21*b* is accommodated in the bushing accommodation hole 24*d* and the blade accommodation hole 24*e* of the cylinder 24. The blade 21*b* oscillates while sliding against the bushings 22. The blade 21*b* moves back and forth along the longitudinal direction thereof.

The compression mechanism 15 includes a compression chamber, which is a space enclosed by the cylinder 24, the piston 21, the front head 23, and the rear head 25. The compression chamber is sectionaiized by the piston 21 into an intake chamber 40*a* communicating with the intake hole 24*b*, and a discharge chamber 40*b* communicating with the discharge channel 24*c*. In FIG. 2, the intake chamber 40*a* and the discharge chamber 40*b* are shown as areas enclosed by the inner peripheral surface of the cylinder 24 and the outer peripheral surface of the piston 21. The volumes of the intake chamber 40*a* and the discharge chamber 40*b* vary according to the position of the piston 21.

(1-2-3 ) Bushing

The bushings 22 are a pair of members assuming a substantially half-column form. The bushings 22 are accommodated in the bushing accommodation hole 24*d* of the cylinder 24 as sandwiching the blade 21*b* of the piston 21. The bushings 22 are shaped from tool steel.

Figure 3:
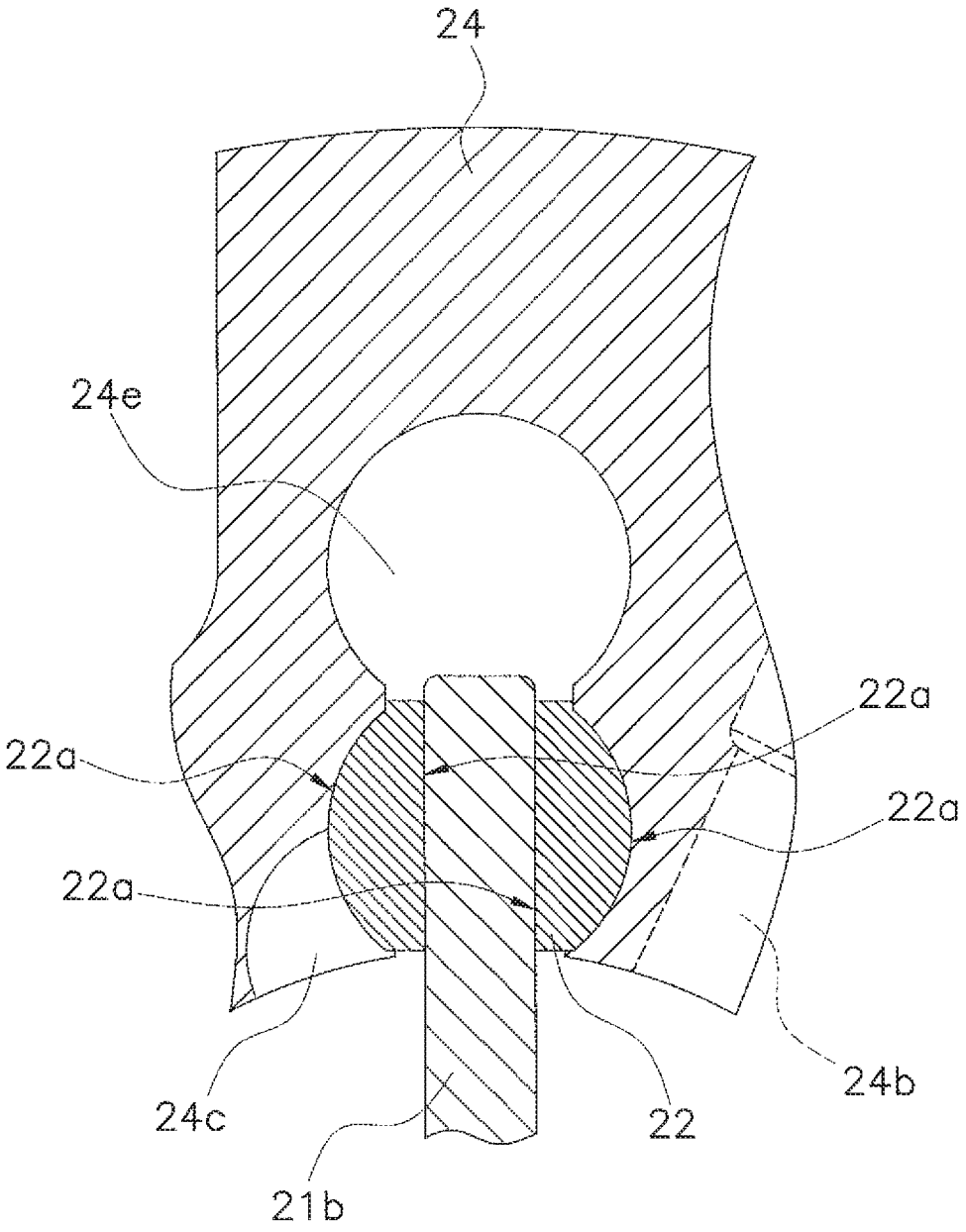
FIG. 3 is an enlargement of the vicinity of the bushings of FIG. 2.

FIG. 3 is an enlargement of the vicinity of the bushings 22 of FIG. 2. The bushings 22 have sliding surfaces 22*a* that slide against the cylinder 24 and the piston 21. The bushings 22 have surface layers including the sliding surfaces 22*a*. The surface layers of the bushings 22 are reformed by a nitriding process. The nitriding process is performed by gas nitriding, ion nitriding, etc. The thickness of each surface layer is, e.g., 10 to 20 μm. The hardness of the surface layers of the bushings 22 in the sliding surfaces 22*a* is at least Hv 1000. The hardness of the surface layers of the bushings 22 is greater than the hardness of the proeutectic Si contained in the Al—Si alloy, which is the material of the cylinder 24 and the piston 21.

(1-2-4) Front Head

The front head 23 is a member that covers the end surface on the upper side of the cylinder 24. The front head 23 is fastened to the casing 10 by bolts, etc. The front head 23 has an upper bearing part 23*a* for supporting the crankshaft 17. The front head 23 has a discharge port 23*b*. The discharge port 23*b* communicates with the discharge channel 24*c* and a high-pressure space S1. The discharge port 23*b* is a flow channel for sending refrigerant compressed by the compression mechanism 15 from the discharge chamber 40*b* to the high-pressure space S1. A discharge valve 23*c*, which closes off an opening in an upper side of the discharge port 23*b*, is attached to the upper surface of the front head 23. The discharge valve 23*c* is a valve for preventing reverse flow of the refrigerant from the high-pressure space S1 to the discharge chamber 40*b*. The discharge valve 23*c* is lifted upward by the pressure of the refrigerant inside the discharge port 23*b*. The discharge port 23*b* thereby communicates with the high-pressure space S1.

(1-2-5) Rear Head

The rear head 25 is a member that covers the end surface on the lower side of the cylinder 24. The rear head 25 has a lower bearing part 25*a* for supporting the crankshaft 17. The cylinder hole 24*a* of the cylinder 24 is closed off by the front head 23 and the rear head 25.

(1-3) Drive Motor

The drive motor 16 is a brushless DC motor accommodated inside the casing 10 and installed above the compression mechanism 15. The drive motor 16 is configured mainly from a stator 51 secured to an inner wall surface of the casing 10, and a rotor 52 that is rotatably accommodated in an inner side of the stator 51 with an air gap provided therebetween.

The stator 51 has a stator core 61 and a pair of insulators 62 attached to both vertical-direction end surfaces of the stator core 61. The stator core 61 has a cylindrical part and a plurality of teeth (not shown) protruding radially inward from an inner peripheral surface of the cylindrical part. A conductive wire is wound around the teeth of the stator core 61 and the pair of insulators 62. A coil 72*a* is thereby formed on each tooth of the stator core 61.

A plurality of notched core cut parts (not shown) arc provided in an outer side surface of the stator 51, from an upper end surface of the stator 51 to a lower end surface at predetermined intervals in the circumferential direction. The core cut parts form a motor cooling passage extending in the vertical direction between the body easing part 11 and the stator 51.

The rotor 52 is configured from a plurality of vertically stacked metal plates. The rotor 52 is linked to the crankshaft 17, which passes vertically through the rotational center of the rotor. The rotor 52 is connected with the compression mechanism 15 via the crankshaft 17.

The rotor 52 has a rotor core 52*a* configured from a plurality of vertically stacked metal plates, and a plurality of magnets 52*b* embedded in the rotor core 52*a*. The magnets 52*b* are arranged at equal intervals along the circumferential direction of the rotor core 52*a*.

(1-4) Crankshaft

The crankshaft 17 is accommodated inside the casing 10 and is arranged so that the axial direction thereof extends along the vertical direction. The crankshaft 17 is linked to the rotor 52 of the drive motor 16 and the piston 21 of the compression mechanism 15. The crankshaft 17 has an eccentric shaft part 17*a*. The eccentric shaft part 17*a* is linked with the roller 21*a* of the piston 21, which is inserted into the cylinder hole 24*a* of the cylinder 24. An end part on an upper side of the crankshaft 17 is linked with the rotor 52 of the drive motor 16. The crankshaft 17 is supported by the upper bearing part 23*a* of the front head 23 and the lower bearing part 25*a* of the rear head 25.

(1-5) Intake Tube

The intake tube 19 is a tube passing through the body casing part 11 of the casing 10. An end part of the intake tube 19 that is inside the casing 10 is fitted into the intake hole 24*b* of the cylinder 24. An end part of the intake tube 19 that is outside the casing 10 is connected to a refrigerant circuit. The intake tube 19 is a tube for supplying refrigerant from the refrigerant circuit to the compression mechanism 15.

(1-6) Discharge Tube

The discharge tube 20 is a tube passing through the upper wall part 12 of the casing 10. An end part of the discharge tube 20 that is inside the casing 10 is positioned in a space above the drive motor 16. An end pan of the discharge tube 20 that is outside the casing 10 is connected to the refrigerant circuit. The discharge tube 20 is a tube for supplying refrigerant compressed by the compression mechanism 15 to the refrigerant circuit.

(2) Operation Of Rotary Compresor

The operation of the rotary compressor 101 shall be described. When the drive motor 16 starts up, the eccentric shaft part 17*a* of the crankshaft 17 rotates eccentrically about the rotational axis of the crankshaft 17. The roller 21*a* of the piston 21 linked to the eccentric shaft part 17*a* therein orbits in the cylinder hole 24*a*. The roller 21*a* orbits while the outer peripheral surface of the piston 21 comes into contact with the inner peripheral surface of the cylinder 24. Due to the orbiting of the roller 21*a*, the blade 21*b* of the piston 21 moves back and forth while both side surfaces of the blade are sandwiched between the bushings 22. The bushings 22 oscillate within the bushing accommodation hole 24*d* while sliding against the cylinder 24 and the blade 21*b* of the piston 21.

As the roller 21*a* orbits, the intake chamber 40*a* communicating with the intake hole 24*b* gradually increases in volume. At this time, low-pressure refrigerant flows into the intake chamber 40*a* from outside the casing 10 through the intake tube 19. Along with the orbiting of the roller 21*a*, the intake chamber 40*a* becomes the discharge chamber 40*b* communicating with the discharge channel 24*c*, the discharge chamber 40*b* gradually decreases i volume, and the discharge chamber again becomes the intake chamber 40*a*. The low-pressure refrigerant drawn into the intake chamber 40*a* from the intake tube 19 through the intake hole 24*b* is thereby compressed in the discharge chamber 40*b*. The high-pressure refrigerant compressed in the discharge chamber 40*b* is discharged through the discharge channel 24*c* and the discharge port 23*b* to the high-pressure space S1. The refrigerant discharged to the high-pressure space S1 passes through the motor cooling passage of the drive motor 16 and flows upward, after which the refrigerant is discharged out of the casing 10 from the discharge tube 20.

(3 ) Characteristics

In the rotary compressor 101 according to the present embodiment, the hardness of the sliding surfaces 22*a* of the bushings 22 that slide against the cylinder 24 and the piston 21 is greater than the hardness of the proeutectic Si contained in the Al—Si alloy, which is the material of the cylinder 24 and the piston 21. Wear on the sliding surfaces 22*a* of the bushings 22, which is caused by the proeutectic Si contained in the cylinder 24 and the piston 21, is thereby restrained. Moreover, the Si content of the Al—Si alloy, which is the material of the cylinder 24 and the piston 21, is greater than 12.6 wt %, which is a eutectic point. Thus, because the Al—Si alloy has a high Si content, wear on the cylinder 24 and the piston 21 is restrained. Due to the amount of wear on the cylinder 24, the piston 21, and the bushings 22 being restrained, the decrease in the reliability of the rotary compressor 101 is restrained. An aluminum-based material such as an Al—Si alloy is also lighter in weight than an iron-based material. Therefore, the weight of the cylinder 24 and the piston 21 can be reduced, and the entire rotary compressor 101 can be reduced in weight. Consequently, the rotary compressor 101 can be reduced in weight and increased in reliability.

In the rotary compressor 101, the cylinder 24 and the piston 21 are shaped from same material. The amount of wear on the cylinder 24 is thereby made the same as the amount of wear on the piston 21, and the service life of the cylinder 24 is therefore made the same as the life of the piston 21. Consequently, the decrease in the service life of the entire rotary compressor 101 is restrained.

(4) Examples (4-1) Example 1

The following is a description of a wear evaluation test performed in order to evaluate the amount of wear of the cylinder 24, the piston 21, and the bushings 22 of the rotary compressor 101.

Figure 4:
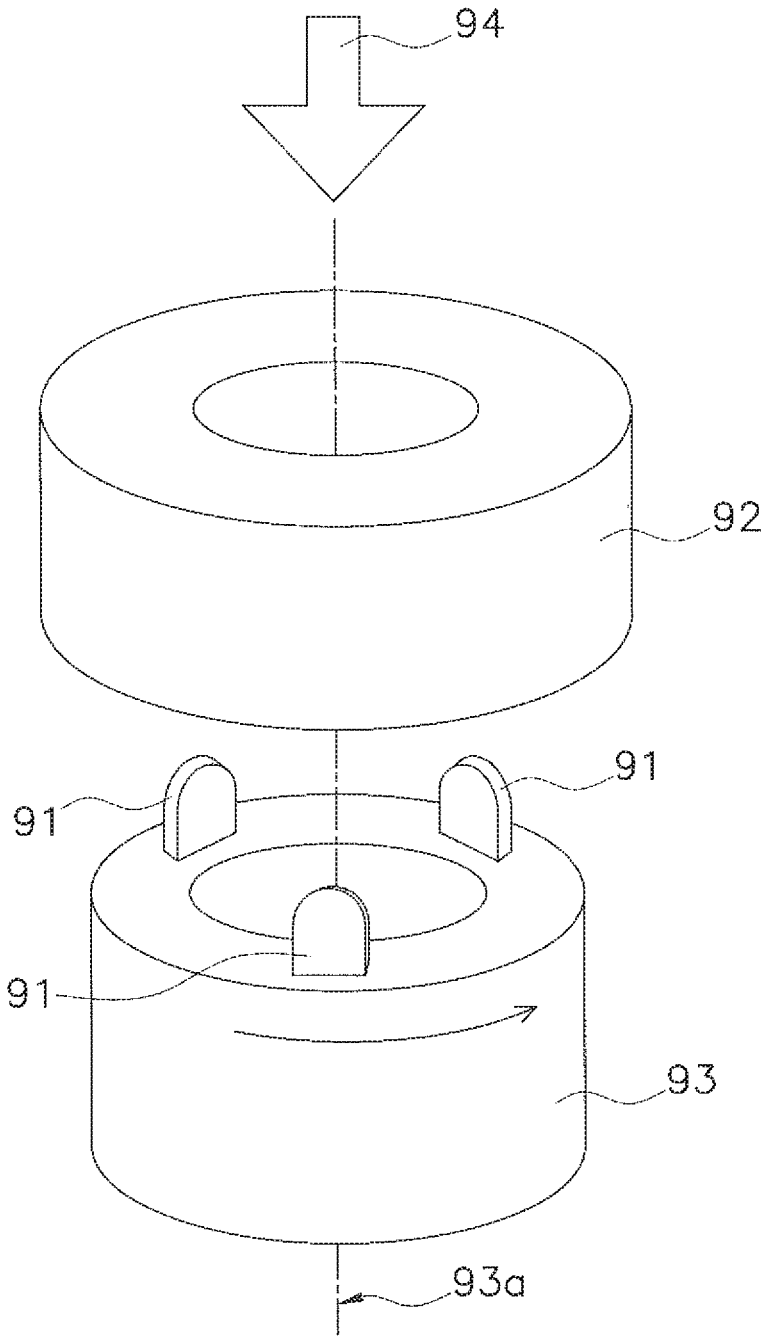
FIG. 4 is a schematic drawing of a wear evaluation test method.
Figure 5:
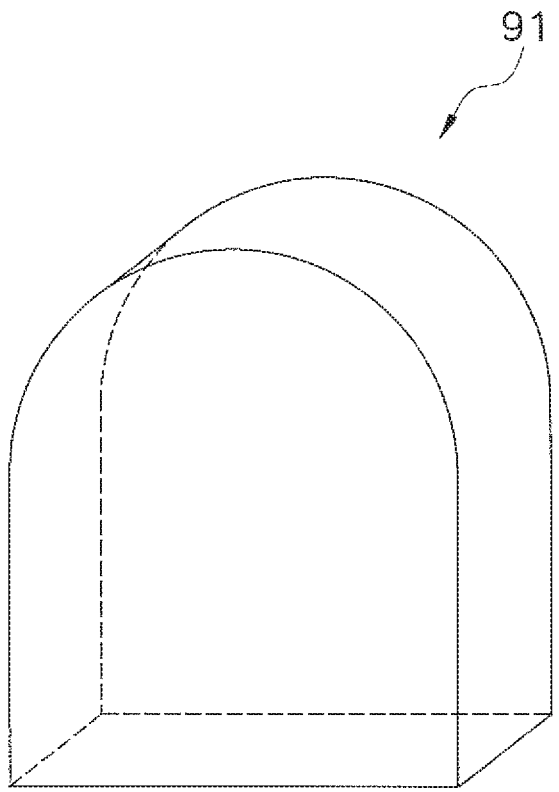
FIG. 5 is an external view of a blade.

FIG. 4 is a schematic drawing of a wear evaluation test method. Two types of test pieces, which are blades 91 and a disc 92, are used in this test. The blades 91 correspond to the bushings 22, and the disc 92 corresponds to the cylinder 24 and the piston 21 FIG. 5 is an external view of a blade 91. Each blade 91 has a rounded upper surface. The blades 91 are secured in three locations on an upper surface of a cylindrical ring 93. The three blades 91 are arranged at equal intervals along the circumferential direction of the ring 93. The disc 92 is of cylindrical shape. The disc 92 is arranged above the ring 93. A lower surface of the disc 92 faces the rounded upper surfaces of the blades 91.

In this test, first, the ring 93 was rotated at a constant speed of 2.0 m/s. Next, a load 94 directed toward the ring 93 was applied to the disc 92 along the direction of a rotational axis 93*a* of the ring 93. The disc 92 was thereby pushed against the three blades 91 secured to the upper surface of the ring 93, and the blades 91 and the disc 92 were made to slide against each other. The load applied to the disc 92 at this time was 600 N. The load applied to the disc 92 was held for one hour. This test was performed in an atmosphere in which a refrigerant R410A and an ether oil FVC68D as a refrigerator oil were mixed at a ratio of 20:30. The frictional coefficient in the sliding surfaces of the blades 91 and the disc 92 was measured at this time. After the test had ended, the amount of wear on the blades 91 and the disc 92 was measured. Table 1 below shows the measurement results of the wear evaluation test.

TABLE 1

| | Material (hardness) | | Frictional | Amount of wear ($mm^3$) | |
|---|---|---|---|---|---|
| Sample | Disc | Blades | Coefficient | Disc | Blades |
| A | 17Si/Al (HRB88) | SCM435 (Hv500) | 0.043 | 0.24 | 0.0018 |
| B | 17Si/Al (HRB88) | SKH51 + DLC (Hv1500) | 0.029 | 0 | 0.0033 |

TABLE 1-continued

| Sample | Material (hardness) Disc | Material (hardness) Blades | Frictional Coefficient | Amount of wear ($mm^3$) Disc | Amount of wear ($mm^3$) Blades |
|---|---|---|---|---|---|
| C | 11Si/Al (HRB86) | SCM435 (Hv500) | >0.07 | galling | |
| D | 11Si/Al (HRB86) | SKH51 + DLC (Hv1500) | >0.07 | galling | |
| E | 11Si/Al (HRB86) | SKH51 + nitriding (Hv1100) | 0.06 | 0.57 | 0.0056 |
| F | 17Si/Al (HRB88) | SKH51 + nitriding (Hv1050) | 0.048 | 0.24 | 0.00042 |
| G | 17Si/Al (HRB88) | SKH51 + nitriding (Hv1200) | 0.048 | 0.24 | 0.00037 |
| H | FC250 (HB200) | SCM435 (Hv500) | 0.065 | 0.26 | 0.00065 |

In Table 1 above, "17Si/Al" alloy having a Si content of 17%; e.g. alloy A390 made by Showa Denko K. K. "11Si/Al" is an Al—Si alloy having a Si content of 11%, e.g., alloy AHS2 made by Showa Denko K K "FC250" is gray cast iron. "SCM435" is chrome molybdenum steel having a carbon amount of 0.33% to 0.38%. "SKH51" is a molybdenum-based high-speed tool steel, which is a type of tool steel. "SKH51+DLC" is a member in which a coating of diamond-like carbon (DLC) has been -formed on the surface of an SKH51 member. "SKH51+nitriding" is a member in which the surface of an SKH51 member has been subjected to a nitriding process.

Comparing sample A and sample H, a combination of steel and an aluminum alloy (17Si/Al) with a Si content higher than the eutectic point (sample A) had greater amount of wear on the blades 91 than a combination of cast iron and steel (sample H).

Comparing sample A and sample B, coating the steel with the PLC caused the frictional coefficient to decrease, but also increased the amount of wear on the blades 91. This was presumably due to the surfaces of the blades 91 being worn by the proeutectic Si, i.e., hard particles contained in the aluminum alloy constituting the material of the disc 92.

Comparing sample A and sample C, the frictional coefficient increased and galling occurred as a result of using an aluminum alloy (11Si/Al) having a Si content lower than the eutectic point in order to reduce the amount of wear on the surfaces of the blades 91 due to the proeutectic Si. Comparing sample B and sample D, the same tendency was confirmed.

Comparing sample A and samples F and G, performing a nitriding process on the steel and bringing the hardness of the surface of the steel to at least Hv 1000 caused the amount of wear on the blades 91 to decrease, with little change to the frictional coefficient and the amount of wear on the disc 92. Comparing sample F and sample G indicates that the amount of wear on the blades 91 decreased in correspondence with an increase in the hardness of the surface of the steel.

Comparing sample E and samples F and G, the frictional coefficient increased and the amount of wear on the disc 92 and the blades 91 also increased when an aluminum alloy (11Si/Al) having a Si content lower than the eutectic point was used, even in cases in which a nitriding process had been performed on the steel.

The above results confirmed that the frictional coefficient and the amount of wear on the disc 92 and the blades 91 can be suppressed by using an aluminum alloy (17Si/Al) having a Si content higher than the eutectic point as the material of the disc 92 and using steel whose surface has been subjected to a nitriding process as the material of the blades 91. It was also confirmed that the amount of wear on the blades 91 decreases in correspondence with an increase in the hardness of the surface of the steel constituting the material of the blades 91.

(4-2) Example 2

Figure 6:
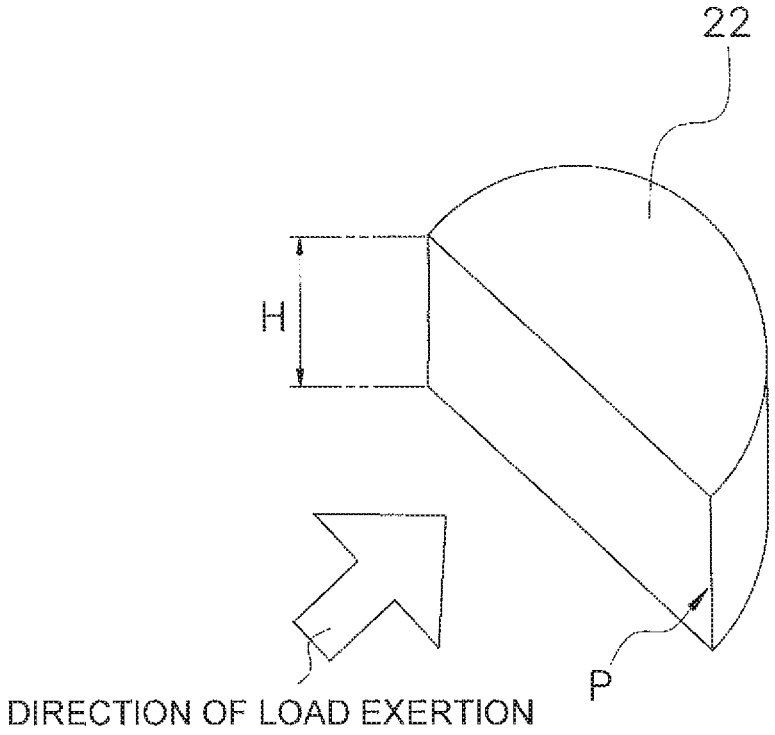
FIG. 6 is a drawing for illustrating a linear maximum-load part of a bushing.
Figure 7A:
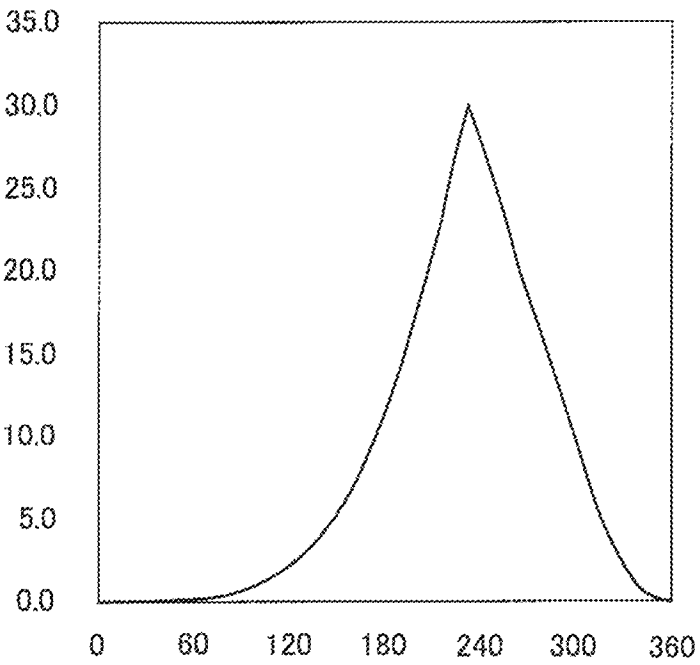
FIG. 7 is a drawing for illustrating fluctuation of a load exerted on the linear maximum-load part during one rotation, and fluctuation of the sliding speed of a blade during one rotation, in a final product.
Figure 7B:
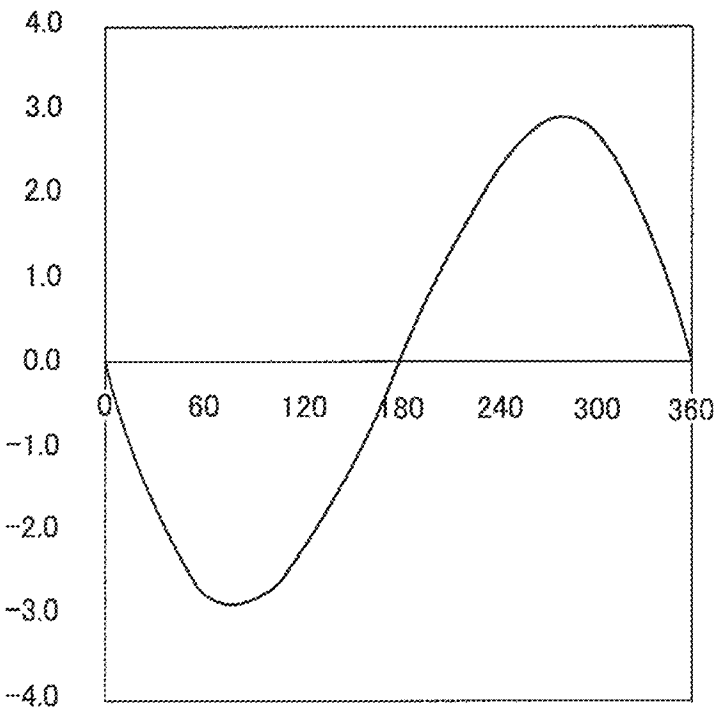
Figure 8:
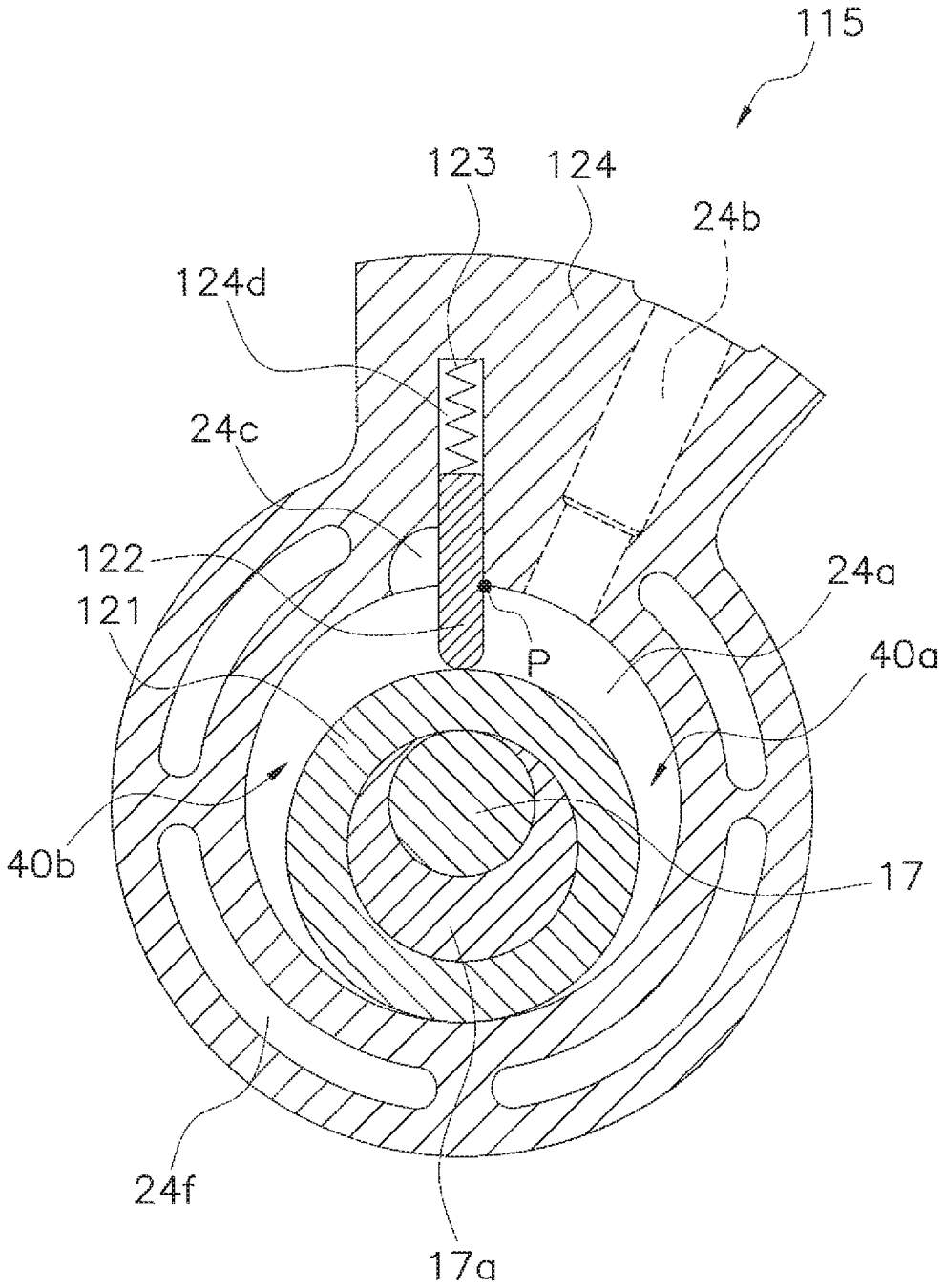
FIG. 8 is a cross-sectional view of a compression mechanism in Modification D.
Figure 9:
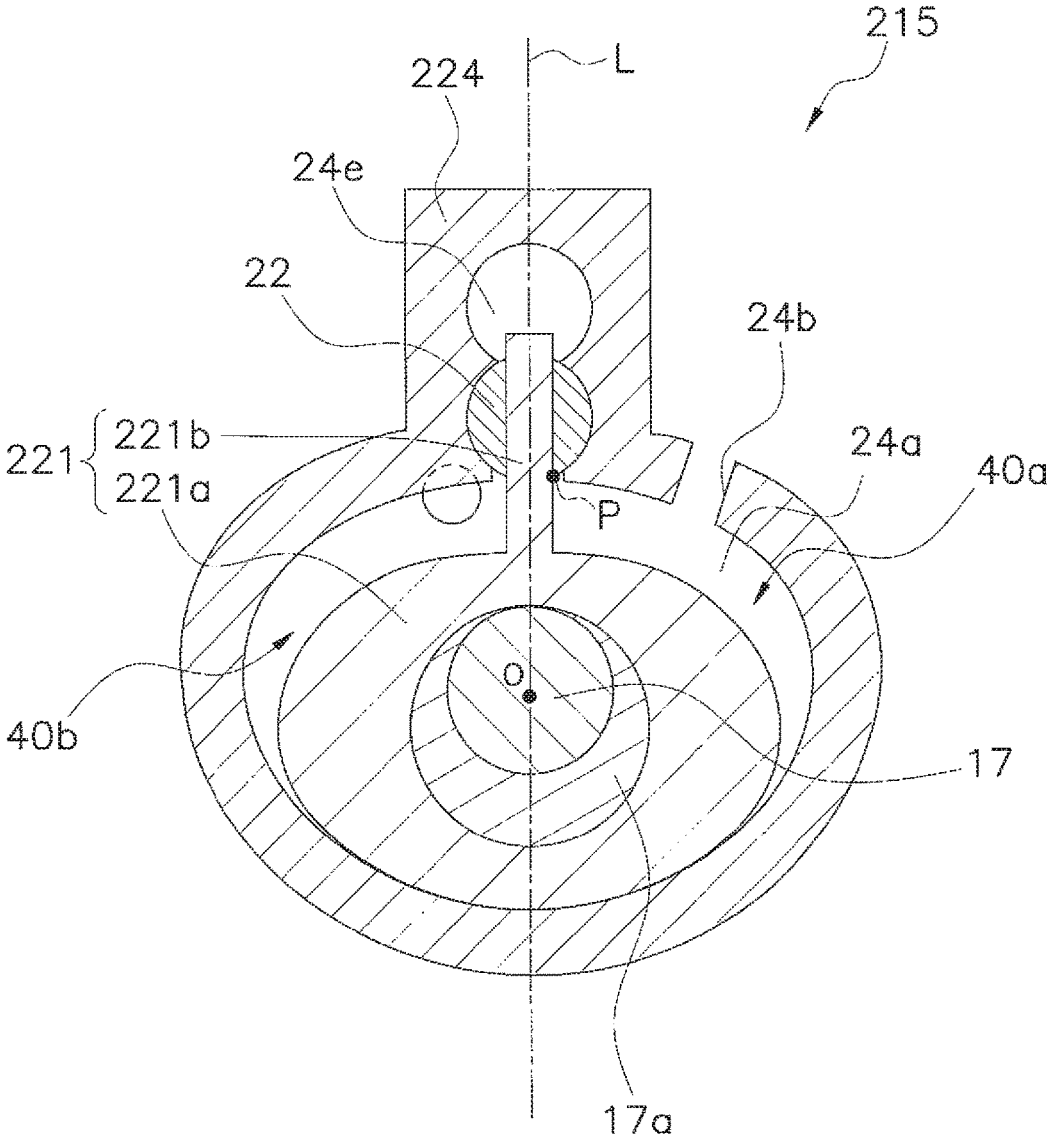
FIG. 9 is a cross-sectional view of a compression mechanism in Modification E.

FIG. 6 is a drawing for illustrating a dimension H of a linear maximum-load part P in a bushing 22 of the present evaluation test FIG. 7 shows (a) fluctuation in the load exerted on the linear maximum-load part P during one rotation in a final product a, and (b) fluctuation in the sliding speed of a blade 21*b* during one rotation. The linear maximum-load part P in FIG. 6 is shown In FIGS. 2, 8, and 9 as well.

In Example 2, an evaluation test was performed, which was for evaluating the effect that the material of the bushings 22 of the rotary compressor 101 and the load received by the bushings 22 had on the amount of wear on the bushings 22.

TABLE 2

| | Element test (400N) | Element test (600N) | Fin. Pro. a | Fin. Pro. b | Fin. Pro. c | Fin. Pro. d |
|---|---|---|---|---|---|---|
| Unit max. load (N/mm) | 33 | 50 | 30 | 30 | 40 | 40 |
| Rotational speed (rps) | — | — | 100 | 130 | 100 | 130 |
| Av. sliding speed (m/s) | 2.0 | 2.0 | 1.8 | 2.3 | 1.8 | 2.3 |
| Unit max load × av. sliding speed | 67 | 100 | 54 | 69 | 72 | 92 |
| DLC coating | ○ | x | ○ | x | x | x |
| Nitriding process | ○ | ○ | ○ | ○ | ○ | ○ |

In Table 2, the Element test (600 N) column shows the results of performing the test under the same conditions as Example 1. In Table 2, the Element test (400 N) column shows the results of performing the test under the same conditions as the Element test (600N) except that the load applied to the disc 92 was changed from 600 N to 400 N.

In Table 2, the unit maximum load (units: N/mm) is represented by the following formula.

Unit maximum load=maximum load (units:N)/dimension H of linear maximum-load part P (units:mm)

The linear maximum-load part is a linear portion in the sliding surface of a bushing 22, or a blade 91 which is equivalent to the bushing 22, where the load is greatest; in other words, a linear portion in the sliding surface where the greatest load is received The unit maximum load equivalent to 400 N in the element test, is 33, and the unit maximum load equivalent to 600 N is 50. In the final products, the load exerted on the linear maximum-load part P fluctuates in accordance with the rotational angle as shown in FIG. 7(*a*). For example, in the final product a, the unit maximum load is 30.

In Table 2, the average sliding speed (units: m/s) is the average value of the sliding speeds of the linear maximum-load part and the cylinder 24 or the piston 21, and is the average value of the sliding speeds of the bushings 22 and the blade 21*b* in the final product (the rotary compressor 101 including the compression mechanism 15 such as is shown in FIG. 2). In the element test, the average sliding speed is 2.0 because the ring 93 is rotated at a constant speed of 2.0 m/s. In the final products, the sliding speeds of the blades fluctuate in accordance with the rotational angle as shown in FIG. 7(*b*). For example, in the final product a, the average sliding speed is 1.8.

In the element test (400 N), the amount of wear on the blades 91 was successfully suppressed even though a nitriding process was performed on the steel to bring the hardness of the surface of the steel to at least Hv 1000, and even though the steel was coated with DLC to bring the hardness of the surface of the steel to at least Hv 1000.

In the element test (600 N), the amount of wear on the blades 91 was not successfully suppressed even though the steel was coated with DLC to bring the hardness of the surface of the steel to at least Hv 1000, but the amount of wear on the blades 91 was successfully suppressed by performing a nitriding process on the steel to bring the hardness of the surface of the steel to at least Hv 1000.

Comparing the final product a with the element test (400 N) and the element test (600 N), with the final product a, in which both the unit maximum load and the average sliding speed were less than in the element test (400 N) and the element test (600 N), the amount of wear on the bushings 22 was successfully suppressed even though a nitriding process was performed on the steel to bring the hardness of the surface of the steel to at least Hv 1000, and even though the steel was coated with DLC to bring the hardness of the surface of the steel to at least Hv 1000.

Comparing the final product b with the element test (400 N) and the element test (600 N), with the final product b, in which the unit maximum load was less and the average sliding speed was greater than in the element test (400 N) and the element test (600 N), the amount of wear on the bushings 22 was not successfully suppressed even though the steel was coated with DLC to bring the hardness of the surface of the steel to at least Hv 1000, but the amount of wear on the bushings 22 was successfully suppressed by performing a nitriding process on the steel to bring the hardness of the surface of the steel to at least Hv 1000.

Comparing the final product c with the element test (400 N) and the element test (600 N), with the final product c, in which the average sliding speed was less than in the element test (400 N) and the element test (600 N) and the unit maximum load was greater than in the element test (400 N) and less than in the element test (600 N), the amount of wear on the bushings 22 was not successfully suppressed even though the steel was coated with DLC to bring the hardness of the surface of the steel to at least Hv 1000, but the amount of wear on the bushings 22 was successfully suppressed by performing a nitriding process on the steel to bring the hardness of the surface of the steel to at least Hv 1000.

Comparing the final product d with the element test (400 N) and the element test (600 N), with the final product d, in which the average sliding speed was greater than in the element test (400 N) and the element test (600 N) and the unit maximum load was greater than in the element test (400 N) and less than in the element test (600 N) the amount of wear on the bushings 22 was not successfully suppressed even though the steel was coated with DLC to bring the hardness of the surface of the steel to at least Hv 1000, but the amount of wear on the bushings 22 was successfully suppressed by performing a nitriding process on the steel to bring the hardness of the surface of the steel to at least Hv 1000.

It was confirmed from the above results that the amount of wear on the bushings 22 could be suppressed if an aluminum alloy (17Si/Al) having a Si content higher than the eutectic point is used as the material of the cylinder 24 and the piston 21 of the rotary compressor 101 and a design indicator (DV) is less than 67 as calculated by the formula: design indicator (DV)=unit maximum load (units: N/mm)/average sliding speed (units: m/s), even when steel coated on the surface with a DLC cover film is used as the material of the bushings 22.

(5) Modifications

The specific configuration of the present embodiment can be altered within a range that does not deviate from the scope of the present invention. Modifications that can be applied to the present embodiment are described below (5-1) Modification A In the present embodiment, the surface layers of the bushings 22 including the sliding surfaces 22*a* are reformed by a nitriding process so that the hardness of the sliding surfaces 22*a* is at least Hv 1000. However, the surface layers of the bushings 22 may be reformed by a nitriding process so that the hardness of the sliding surfaces 22*a* is even higher. For example, the surface layers of the bushings 22 may be reformed by a nitriding process so that the hardness of the sliding surfaces 22*a* is at least Hv 1200.

(5-2) Modification B

In the present embodiment, the bushings 22 are shaped from tool steel, but may be shaped from another material of which the hardness of the surface is at least Hv 1000. For example, the bushings 22 may be shaped from alumina ($Al_2O_3$), zirconia ($ZrO_2$), silicon carbide (SiC), silicon nitride ($Si_3N_4$), boron nitride (BN), or other ceramics.

(5-3) Modification C

In the present embodiment, the compression mechanism 15 is a single-cylinder compression mechanism, but may be a dual-cylinder compression mechanism.

(5-4) Modification D

In the present embodiment, the compression mechanism 15 has bushings 22 that slide against the piston 21 and the cylinder 24. In this compression mechanism 15, the blade 21*b* of the piston 21 moves back and forth while being sandwiched on both side surfaces by the bushings 22, and the bushings 22 oscillate while sliding against the cylinder 24 and the blade 21*b* of the piston 21.

However, the rotary compressor 101 may have a compression mechanism 115 including a roller 121 and a vane 122 as shown m FIG. 8, FIG. 8 is a cross-sectional view, similar to FIG. 2, of the compression mechanism 115. In FIG. 8, the same constituent elements as those in FIG. 2 are indicated by the same reference symbols. The compression mechanism 115 is configured mainly from the roller 121, the vane 122, a spring 123, and a cylinder 124. The vane 122 and the spring 123 are accommodated in a vane accommodation hole 124*d*. The rotation of the roller 121 causes the vane 122 to move back and forth in the vane accommodation hole 124*d*, and the spring 123 to push the vane 122 against the roller 121. An intake chamber 40*a* and a discharge chamber 40*b* are thereby formed in the compression mechanism 115.

In the present modification, the vane 122 slides against the roller 121 and the cylinder 124. The vane 122 is equivalent to the bushings 22 of the present embodiment, and is shaped from tool steel. The surface layer of the vane 122 is reformed so that the hardness of the surface of the vane 122 is at least Hv 1000. Specifically, the surface layer of the vane 122 is either reformed by a nitriding process or coated with a DLC thin film. When the surface layer of the vane 122 is coated with a DLC thin film, the design indicator (DV) must be less than 67 as calculated by the formula: design indicator (DV)=unit maximum load (units; N/mm)×average sliding speed (units: m/s). In the rotary compressor 101 including the compression mechanism 115 such as that shown in FIG. 8, a linear maximum-load part for calculating the unit maximum load (units: N/mm) is a linear portion in the sliding surface of the vane 122 where the load is greatest, and the average sliding speed (units: m/s) is the average value of the sliding speeds of the vane 122 and the cylinder 124. The roller 121 and the cylinder 124 are respectively equivalent to the piston 21 and the cylinder 24 of the present embodiment, and are shaped from an Al—Si alloy. This Al—Si alloy has a Si content exceeding 12.6 wt %, which is a eutectic point.

(5-5) Modification E

In the compression mechanism 15 of the present embodiment, the outer peripheral surface shape of the roller 21*a* of the piston 21 is formed into a perfect circle.

However, in a compression mechanism 215 of the rotary compressor 101, an outer peripheral surface shape of a roller 221*a* may be formed in a non-circular shape, as shown in FIG. 9. In this case, an inner peripheral surface shape of a cylinder 224 is also formed in a non-circular shape. Concerning the shape of the roller 221*a*, when a blade 221*b* of a piston 221 is positioned so as to extend along a line L that passes through a center O of the crankshaft 17 and is orthogonal to the crankshaft 17, the outer peripheral surface shape of the roller 221*a* may be symmetrical with respect to the line L (see FIG. 9), or the outer peripheral surface shape of the roller 221*a* may be asymmetrical with respect to the line L. Thus, due to the outer peripheral surface shape of the roller 221*a* being formed in a non-circular shape, the load received by the bushings 22 when the bushings 22 slide against the cylinder 224 and the blade 221*b* of the piston 221 can be reduced more than when the outer peripheral surface shape of the roller 21*a* is formed into a perfect circle.

INDUSTRIAL APPLICABILITY

The compressor according to the present invention can be reduced in weight and Increased in reliability.

What is claimed is:

1. A compressor comprising:
a cylinder including a cylinder chamber;
a piston movably arranged relative to the cylinder in the cylinder chamber; and
a sliding member slideable against the cylinder and the piston in the cylinder chamber,
the cylinder and the piston being constructed from an Al—Si alloy having a Si content exceeding 12.6 wt %, which is a eutectic point,
the sliding member being constructed from steel and having a surface layer including a sliding surface slideable against the cylinder and the piston, and
the surface layer having greater hardness than a hardness of proeutectic Si contained in the Al—Si alloy, and the surface layer having hardness of least Hv 1000 in the sliding surface.

2. The compressor according to claim 1, wherein
the surface layer is treated using a nitriding process.

3. The compressor according to claim 2, wherein
the surface layer has hardness of at least Hv 1200 in the sliding surface.

4. The compressor according to claim 2, wherein
the cylinder and the piston are constructed from a common material.

5. The compressor according to claim 2, wherein
the piston has a roller and a blade secured to an outer peripheral surface of the roller, and an outer peripheral surface shape of the roller is formed in a non-circular shape.

6. The compressor according to claim 2, wherein
the sliding member is constructed from tool steel.

7. The compressor according to claim 1, wherein
a design indicator is calculated from
a unit maximum load, which is maximum load exerted per unit length of 1 mm on a linear maximum-load part, which is a linear portion in the sliding surface where load received from the cylinder or the piston is greatest, and
an average sliding speed, which is an average value of the sliding speeds of the linear maximum-load part and either the cylinder or the piston,
the design indicator=unit maximum load×average sliding speed,
the design indicator is less than 67, and
the reforming involves applying a DLC thin-film coating.

8. The compressor according to claim 7, wherein
the surface layer has hardness of at least Hv 1200 in the sliding surface.

9. The compressor according to claim 7, wherein
the cylinder and the piston are constructed from a common material.

10. The compressor according to claim 7, wherein
the piston has a roller and a blade secured to an outer peripheral surface of the roller, and an outer peripheral surface shape of the roller is formed in a non-circular shape.

11. The compressor according to claim 7, wherein
the sliding member is constructed from tool steel.

12. The compressor according to claim 1, wherein
the surface layer has hardness of at least Hv 1200 in the sliding surface.

13. The compressor according to claim 12, wherein
the piston has a roller and a blade secured to an outer peripheral surface of the roller, and an outer peripheral surface shape of the roller is formed in a non-circular shape.

14. The compressor according to claim 12, wherein
the sliding member is constructed from tool steel.

15. The compressor according to claim 1, wherein
the cylinder and the piston are constructed from a common material.

16. The compressor according to claim 15, wherein
the piston has a roller and a blade secured to an outer peripheral surface of the roller, and an outer peripheral surface shape of the roller is formed in a non-circular shape.

17. The compressor according to claim 15, wherein
the sliding member is constructed from tool steel.

18. The compressor according to claim 1, wherein
the piston has a roller and a blade secured to an outer peripheral surface of the roller, and an outer peripheral surface shape of the roller is formed in a non-circular shape.

19. The compressor according to claim 1, wherein
the sliding member is constructed from tool steel.

20. The compressor according to claim 1, wherein
R32 is used as a refrigerant.

* * * * *